US012179957B2

(12) United States Patent
Andrade

(10) Patent No.: US 12,179,957 B2
(45) Date of Patent: Dec. 31, 2024

(54) REPOSITIONABLE CONTAINER PARTITIONING SYSTEM USED WITH DIVIDER INSERT

(71) Applicant: Brenda Andrade, Ventura, CA (US)

(72) Inventor: Brenda Andrade, Ventura, CA (US)

( * ) Notice: Subject to any disclaimer, the term of this patent is extended or adjusted under 35 U.S.C. 154(b) by 0 days.

(21) Appl. No.: 17/847,007

(22) Filed: Jun. 22, 2022

(65) Prior Publication Data

US 2022/0402654 A1 Dec. 22, 2022

Related U.S. Application Data

(60) Provisional application No. 63/259,116, filed on Jun. 22, 2021.

(51) Int. Cl.
*B65D 25/06* (2006.01)

(52) U.S. Cl.
CPC ..... *B65D 25/06* (2013.01)

(58) Field of Classification Search
CPC ..... B65D 25/04; B65D 25/06
USPC ..... 206/561; 220/529, 533, 532
See application file for complete search history.

(56) References Cited

U.S. PATENT DOCUMENTS 943,719 A * 12/1909 Vick ..... B65D 9/34 217/18
3,656,651 A * 4/1972 Hage ..... A47B 88/975 220/533
4,081,100 A * 3/1978 Presby ..... A47B 88/90 220/543
4,234,089 A * 11/1980 Morris ..... B65D 25/06 220/532
4,946,037 A 8/1990 Keith
5,620,243 A 4/1997 Billingham
6,085,932 A 7/2000 Cope
(Continued)

*Primary Examiner* — Nathan J Jenness
*Assistant Examiner* — Elizabeth J Volz

(57) ABSTRACT

A container/box partitioning system that utilizes a pair of repositionable and removable vertical channel apparatuses that impermanently attach to opposed inner container walls. The vertical channel apparatuses impermanently attach to the top edge/wall of the container using a pressure clip with many possible embodiments (e.g. tension, spring, snap/click). A divider partition sized to fit whatever container being used is inserted into the channel apparatuses creating a partition. The vertical channel apparatuses can be repositioned/moved by lifting up/down or by sliding horizontally along the top edge of the container when the pressure clip is not being utilized. The vertical channel apparatuses feature a low profile flat panel/backplate incorporated therein which abuts to opposing wall(s) from the bottom of the file box/container to the top edge of the file box/container wall connecting to the clip mechanism. The width and design of the backplate and channel has many possible embodiments (e.g. rectangular, triangular). The base width of the vertical channel backplate serves to prevent the apparatuses and divider partition from moving from the weight of the container contents. The counter pressure created by the base width of the backplate on the base edge of the inner container serves to keep the repositionable channel apparatuses vertical and therefore maintaining the partitioned items in the desired location and orientation by preventing the items from moving and/or falling over within the container.

7 Claims, 15 Drawing Sheets

(56) References Cited

U.S. PATENT DOCUMENTS

| | | | | |
|---|---|---|---|---|
| 6,357,844 | B1 * | 3/2002 | Muterthies | A47B 88/90<br>220/543 |
| 2004/0007486 | A1 | 1/2004 | Bergh | |
| 2004/0045511 | A1 * | 3/2004 | Migita | A01K 1/031<br>119/472 |
| 2006/0124500 | A1 | 6/2006 | Mena | |
| 2018/0148221 | A1 * | 5/2018 | Hill | B65D 25/06 |

* cited by examiner

REPOSITIONABLE CONTAINER PARTITIONING SYSTEM USED WITH DIVIDER INSERT

CROSS REFERENCE TO EARLIER FILED APPLICATION

This application claims the benefit of the earlier filing date of provisional application Ser. No. 63/259,116, filed Jun. 22, 2021.

BACKGROUND OF THE INVENTION

The present invention is in the field of container box dividers. More particularly, the present invention relates to a file box/container partitioning system having repositionable and removable opposing channels that secure removable dividers/partitions without having to remove or transfer vertical files or other contents of the file box/container.

It is common to store files/folders vertically in a corrugated cardboard box and at times utilize the storage box to organize and work directly with the files while in the storage box. The problem occurs when the file box/container is not full and there is no rigid partition in the storage box to keep the files/folders from falling over. It is then difficult to see file tabs and retrieve or file documents. This divider system will keep files upright/in place even when the file box/container is not completely full. This file box/container divider system can be easily removed, repositioned and reused without removing the contents or damaging the file box/container.

The task of keeping papers and file folders upright when the file storage box is not full has been attempted to be addressed in a couple of ways over the years. Hanging file folders which were intended to be hung from steel rails in filing cabinets have been utilized by hanging the file folder from a top edge of the corrugated cardboard file box. The problem with this system is that the hanging file folder tends to move or slide from their intended location in the file box unless the file box is full. Because of the lack of rigidity of hanging file folders the lower portion of the hanging file folder tends to move with the weight of the files, resulting in the files being pushed over on their sides and causing unwanted creases or curvature in the documents placed in the hanging file folder. In addition, hanging file folders do not touch/connect to the file box bottom so the file box is not fully compartmentalized, thereby allowing for more inter-container movement that may damage or mix the items stored in the file box/container. Another problem with hanging file folders is that the semi-rigid structure of a corrugated cardboard box may be insufficient to support the metal hangers attached to the file folders. In addition, the width of the documents in any one hanging file folder must be smaller than the bottom width of the hanging file folder. Therefore, documents have to be removed from the folders and file box in order to adjust the file folder size and location of the documents in the file box.

If the width of the of the partitioned space is determined by having multiple stationary dividers and/or channels incorporated into the file box/container then if the preset divider partitioned space is wider than the documents stored therein, the documents will not remain vertical and will fall over. Some file boxes have incorporated divider/partitions that are a set width from each other so you can't securely store large items because they are larger than the set compartment width and you can't store small/narrow items/documents without the contents falling over. Therefore, a need remains to solve the aforementioned problems and keep the files/folders upright and organized regardless if the file box/container is full or only partially full and the presently described embodiments address this need.

In accordance with the above, a container/box partitioning system is provided. The system utilizes a pair of repositionable and removable vertical channel apparatuses that impermanently attach to opposed inner container walls. The vertical channel apparatuses impermanently attach to the top edge/wall of the container using a pressure clip with many possible embodiments (e.g. tension, spring, snap/click). A divider partition sized to fit whatever container being used is inserted into the channel apparatuses creating a partition. The vertical channel apparatuses can be repositioned/moved by lifting up/down or by sliding horizontally along the top edge of the container when pressure clip is not being utilized. The vertical channel apparatuses feature a low profile flat panel/backplate incorporated therein which abuts to opposing wall(s) from the bottom of the file box/container to the top edge of the file box/container wall connecting to the clip mechanism. The width and design of the backplate and channel has many possible embodiments (e.g. rectangular, triangular). The base width of the vertical channel backplate serves to prevent the apparatuses and divider partition from moving from the weight of the container contents, and also ensures a minimal separation distance between the content positioning apparatuses. The counter pressure created by the base width of the backplate on the base edge of the inner container serves to keep the repositionable channel apparatuses vertical by preventing tilting and therefore maintaining the partitioned items in the desired location and orientation by preventing the items from moving and/or falling over within the container. The channel and backplate abuts to the container wall and is temporarily affixed by clips to the outside/top edge of the container. These channel apparatuses are easily repositionable or removable by lifting each of the apparatuses up, therefore, not requiring the contents of the container to be removed first and are able to be reused in other file boxes. If the file box/container is empty (empty on the other side of the partition that's not being utilized for storage) the vertical channel apparatuses are repositionable by lifting up/down or by sliding along the top container wall edge to expand or reduce the compartment size as needed depending on size of the contents being stored/separated within the file box/container.

SUMMARY OF THE INVENTION

The present invention consists of a pair of repositionable vertical channel apparatuses that impermanently attach to the inner opposite sides of a container/box making a channel that a divider can slide down creating a division or compartment inside the container. The partition/divider may be made of various materials (e.g. cardboard, plastics, hard/foam board). This partition/divider can be placed anywhere in the container (depending on the base width of the backplate of that particular embodiment) because the separate vertical channel apparatuses are repositionable. Having separate vertical channel apparatuses also allows one to utilize them with various types of containers (e.g. cardboard file box, plastic storage box, drawers). The repositionable vertical channel apparatus of this invention may be made of various materials (e.g. plastics, metals, ridged boards). Additional features of the invention will be described below and will form the subject matter of claims appended herein.

It is to be understood that the invention is not limited in its application to the detail of design and to the process set fourth in the following description or illustrated in the drawings. The invention can be adapted and utilized to store many different items and may be reconfigured in various different ways. The terminology and phraseology used herein are for the purpose of description and shouldn't be regarded as limiting.

BRIEF DESCRIPTION OF THE DRAWINGS

The present invention may be better understood and its numerous features and advantages made apparent to those skilled in the art by referencing the accompanying drawings.

DETAILED DESCRIPTION OF THE PREFERRED EMBODIMENTS

The present invention is directed to an apparatus that can be used to partition or divide a permanent or temporary container to separate, e.g., groups of files contained therein. To that end, the apparatus consists of an opposable pair of repositionable vertical channel apparatuses that impermanently attach to the inner opposite sides of a container/box making a channel that a divider can slide down creating a division or compartment inside the container.

Figure 1:
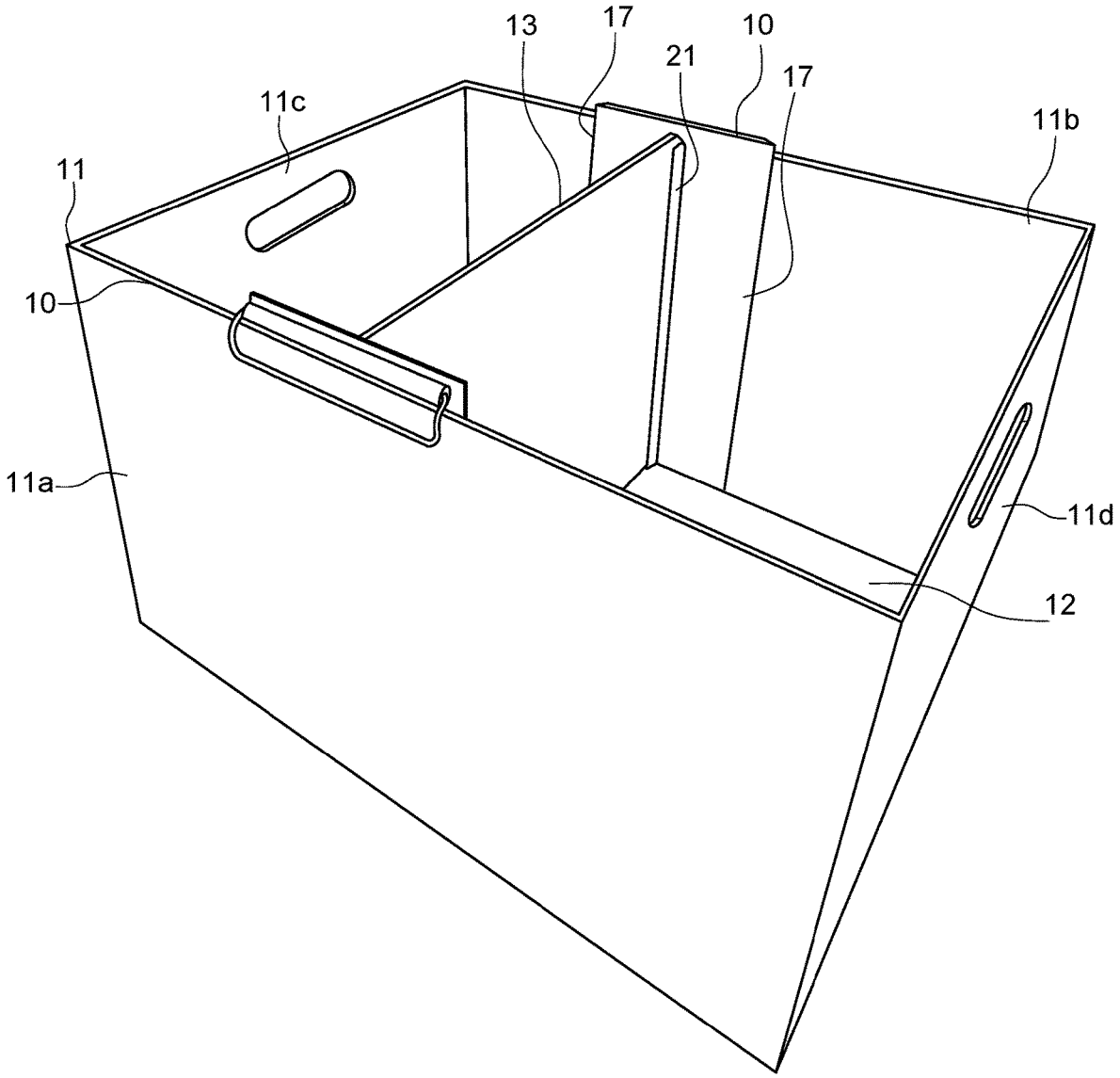
FIG. 1 is a perspective view of a container with the repositionable vertical channel apparatuses impermanently attached by spring clip embodiment and removable divider.

Shown in FIG. 1 is a perspective view of the repositionable vertical channel apparatuses 10 of the present invention being utilized to compartmentalize/partition a container 11 with a removable divider insert 13. With reference to FIG. 1, the file box/container generally designated 11 is comprised of four side walls 11*a*, 11*b*, 11*c* and 11*d* and a bottom panel 12. The partition/divider 13 may be fabricated of any suitable material including cardboard, plastic, and rigid board and will be sized to fit the container 11 being partitioned.

The vertical channel apparatuses 10 may be fabricated of any suitable rigid material including plastics and metals. Each repositionable vertical channel apparatus 10 is comprised of a backplate 14 with a clip 15 at the top back of the backplate 14 and a channel 16 extending from one side of the backplate 14 vertically along the front side of the backplate 14 within the container 11. The opposing or abutment side of the backplate 14 is positioned flush against one of the sidewalls 11*a*-11*d*. The clip 15 is preferably spring loaded and may have a roughened texture on its interior surface to allow for slip reducing frictional engagement with the top edges of sidewalls 11*a*-11*d*, the clip 15 biased in the closed position. When temporarily or releasably attached to the container 11 being used (a variety of containers may be used) the top clip 15 compresses the top wall/edge 11*a*-11*b* against the backplate 14 holding each of the vertical channel apparatuses 10 in place.

Because the vertical channel apparatuses 10 are identical and separate, the invention can be utilized on various types and sizes of containers/boxes 11 by using different sized divider inserts 13, as the spacing between the apparatuses 10 is infinitely variable. This allows one to partition a rectangular file box 11 lengthwise 11*c*-11*d* and/or widthwise 11*a*-11*b* and possibly both at the same time with 2 or more sets of the repositionable vertical channel apparatuses 10. The repositionable vertical channel apparatuses 10, which are always used in opposing pairs, can impermanently attach either to the side walls 11*a*, 11*b*, 11*c* and 11*d* of the container 11 or a divider/partition wall 13 that is already being utilized within the container providing for multiple possible container 11 compartmentalization configurations. The apparatuses 10 will have a height corresponding to the height of the divider walls 13 so that the top of the divider wall 13 is even with the top of the apparatuses 10. In the case of containers used for temporary file storage, the containers tend to come in standard sizes which will dictate the height of the apparatuses 10, that is, the height of the apparatuses is predetermined according to the size of the container in which they are to be positioned. Of course, the apparatuses 10 can be fabricated for non-standard sized containers.

Figure 2:
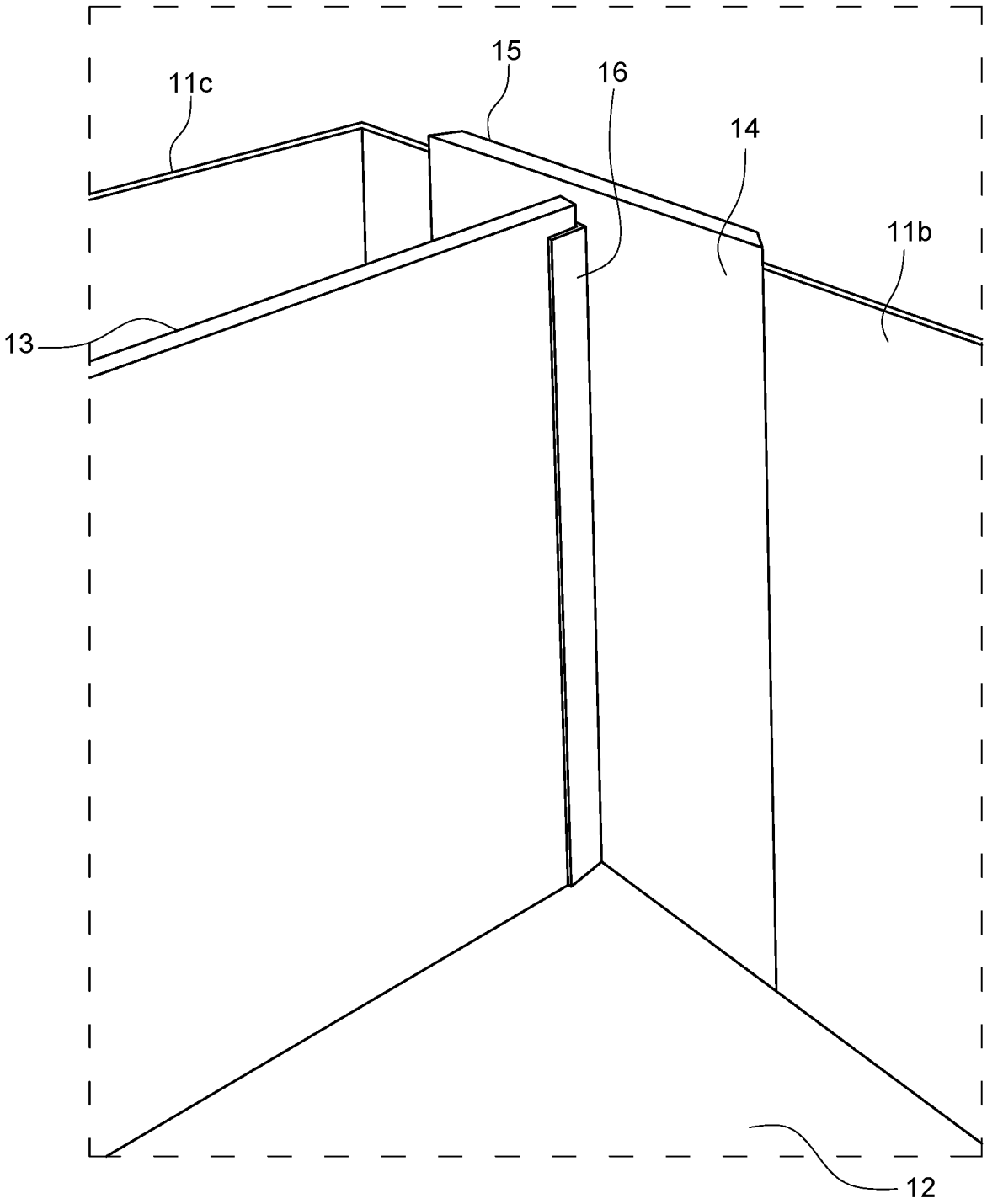
FIG. 2 is a perspective view of a vertical channel apparatus of the present invention within the container with the removable divider.

FIG. 2 shows a closer perspective view of FIG. 1 featuring only one of the repositionable vertical channel apparatus 10 impermanently attached to a container 11 wall 11*b* by attachment clip 15 with the removable divider 13 inserted creating a compartment(s) within the container/box.

Figure 3:
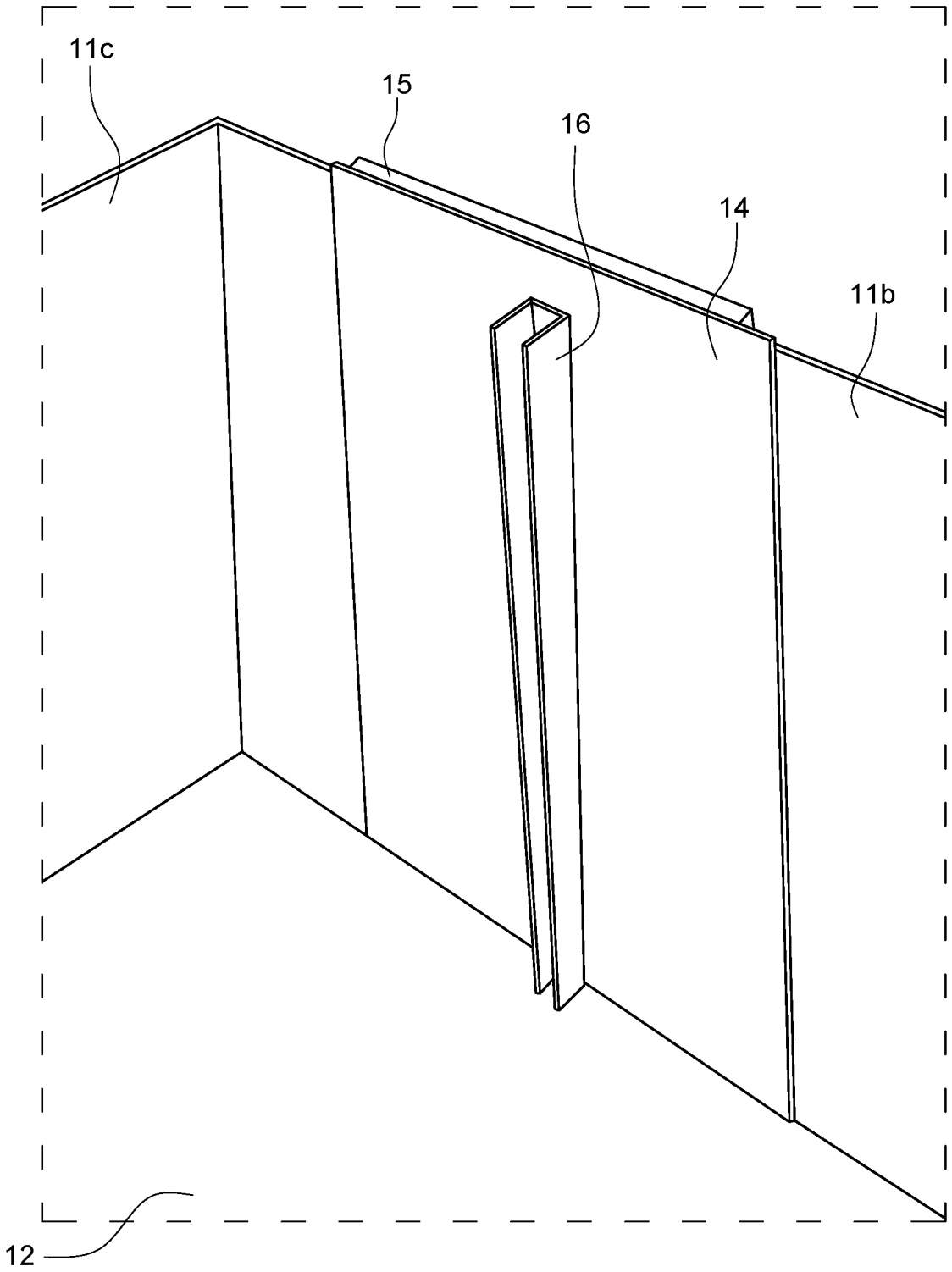
FIG. 3 is a perspective view of a vertical channel apparatus of the present invention within the container without the removable divider.

FIG. 3 shows a closer perspective view of FIG. 1 featuring only one of the repositionable vertical channel apparatuses 10 impermanently attached to a container 11 wall 11*b* by attachment clip 15 without the removable divider within the container/box. The base width of the backplate 14, more particularly the base width from the vertical channel 16 to the outer edge of the backplate 14, determine the size of the narrowest or widest compartment that can to created within the container 11. Thus, the base width may be varied to allow for more or fewer total compartments within a given size container 11. Users may partition containers 11 to have, for example, one large compartment, and several narrower compartments. It should be noted that the backplates 14 can be arranged to abut in edge to edge fashion along the walls 11*a-d* so that the spacing between dividers 13 (when in position as described above) will be constant even in the event of weight shifting of the contents (typically files) of the container. As the backplates 14 cannot overlap or slide over one another, the compartment created by adjoining backplates 14 will retain its dimension even when weight is shifting inside the container 11, even in the event of failure of the attachment clip 15. This limiting of weight shifting prevents a sudden change in the center of gravity of the container 11 which can cause injury as paper files can be very heavy. Files can also be easier to visualize and remove if spacing is maintained in the manner of the present invention.

Figure 4:
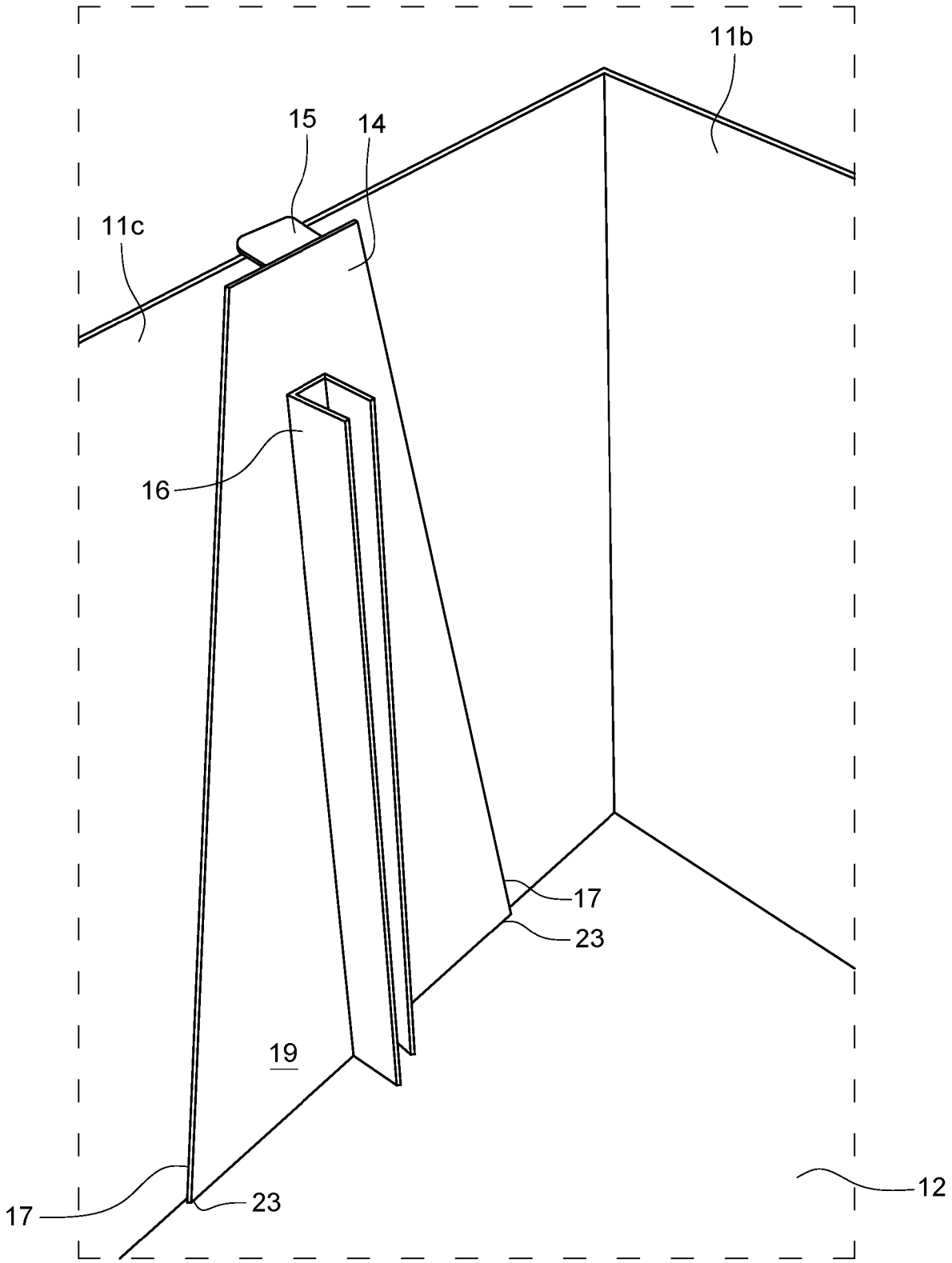
FIG. 4 is a perspective view of the vertical channel apparatus with a different backplate embodiment within the container without the removable divider.

FIG. 4 shows a perspective view of the vertical channel apparatus 10 with a triangular backplate 14 embodiment within the container 11 without the removable divider insert 13. The base of the backplate 14 serves to provide opposing edges or abutments 17 against which adjacent apparatuses 10, if any, will abut, this action setting the minimum distance between adjacent apparatuses 10. The triangular base 19 reduces the amount of material needed to make the apparatus, and also reduces weight without compromising function, the abutments formed as tips 23 of the triangle. The repositionable channel apparatus 10 is impermanently attached by clip mechanism 15 to the container wall 11*a*. The other repositionable channel apparatus 10 would be positioned on opposite side wall 11*b* creating inner container 11 channels 16 for the divider/partition insert 13.

Figure 5:
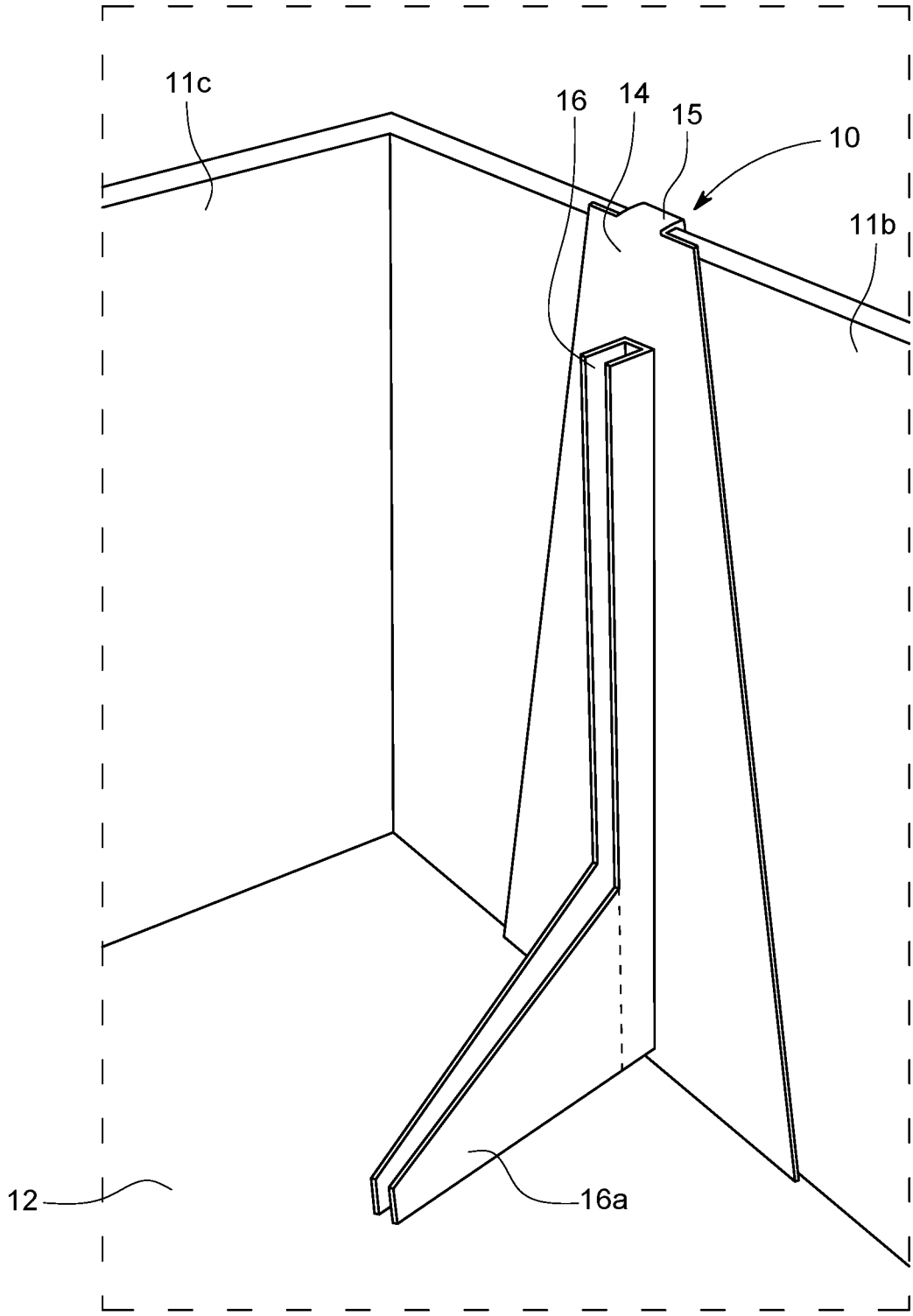
FIG. 5 is a perspective view of the vertical channel apparatus with a different vertical channel fin embodiment within the container without the removable divider.

FIG. 5 shows a perspective view of the vertical channel apparatus 10 with a triangular backplate 14 and vertical channel fin 16/16*a* embodiment within the container 11 without the removable divider insert 13. The channel fin embodiment 16*a* reinforces and helps stabilize the vertical channel apparatuses 10 and the divider/partition 13 when inserted in the channels of the repositionable vertical channel apparatuses 10 of the present invention.

Figure 6:
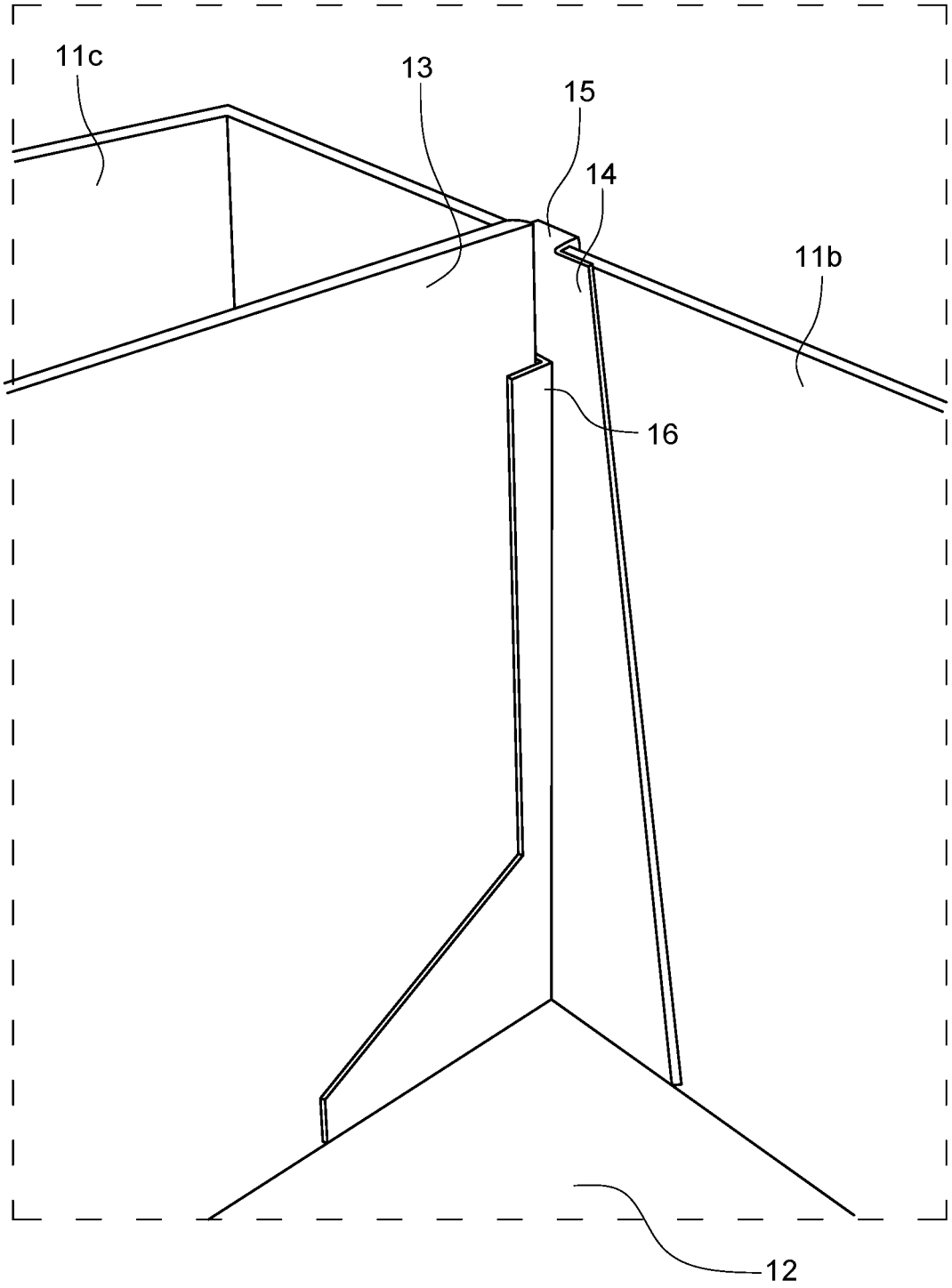
FIG. 6 is a perspective view of the vertical channel apparatus with different backplate and attachment clip embodiments within the container with the removable divider.

FIG. 6 shows a perspective view of the vertical channel apparatus 10 with a triangular backplate 14 and vertical channel fin 16/16*a* embodiment within the container 11 with the removable divider insert 13. The channel fin embodiment 16*a* reinforces and helps stabilize the vertical channel apparatuses 10 and the divider/partition 13 when inserted in the channels of the repositionable vertical channel apparatuses 10 of the present invention.

Figure 7:
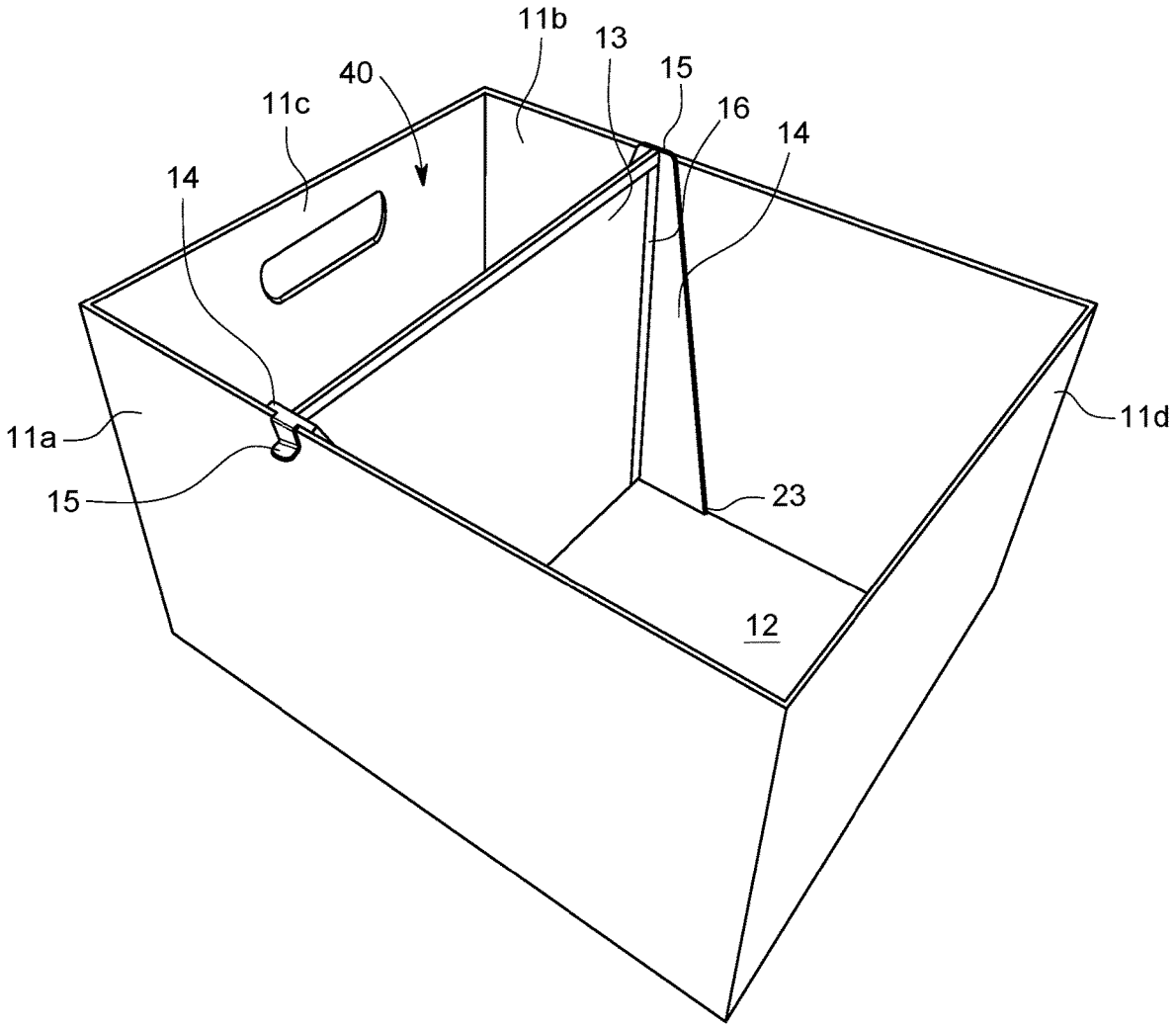
FIG. 7 is a perspective view of a container with the repositionable vertical channel apparatuses impermanently attached by tension clip embodiment and removable divider.

FIG. 7 shows a perspective view of the vertical channel apparatuses 10 of the present invention with triangular backplate 14 and vertical channel fin 16/16*a* embodiment within the container 11 with the removable divider insert 13.

Figure 8:
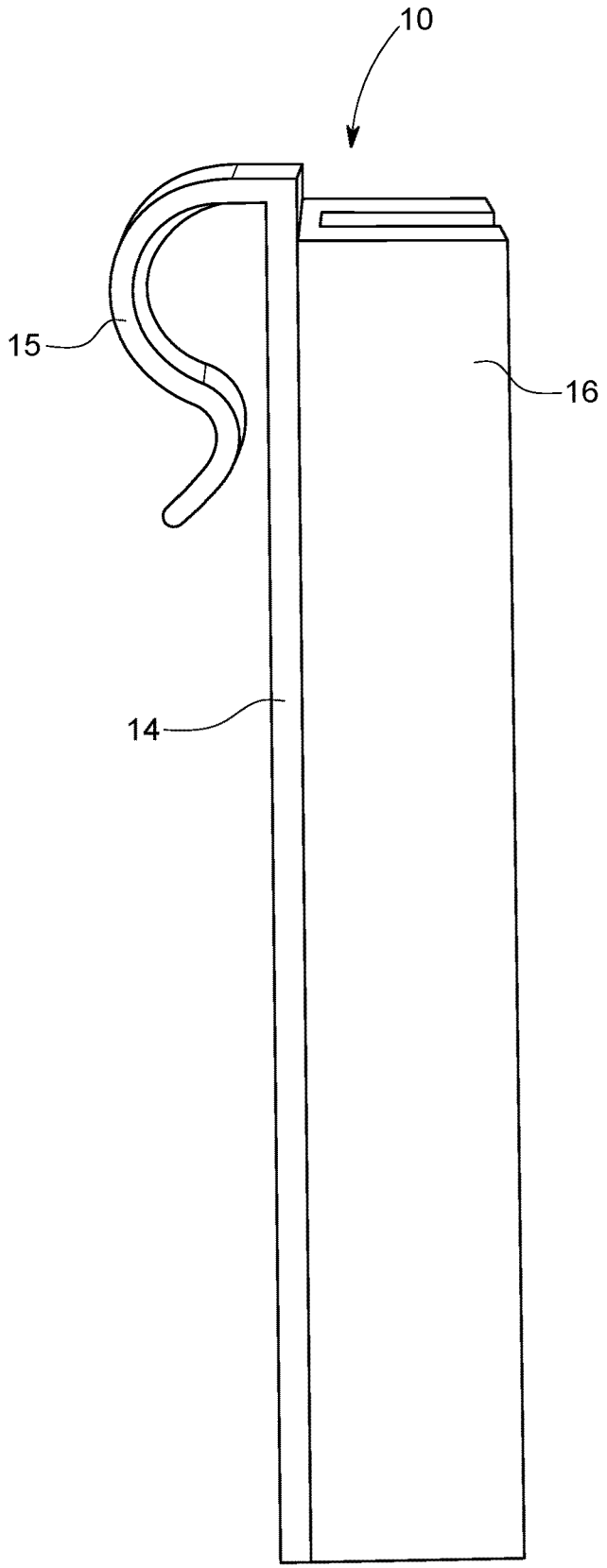
FIG. 8 is a side perspective view of the top of the vertical channel apparatus depicting the tension clip embodiment of the attachment mechanism of the invention.

FIG. 8 shows a perspective side view of the vertical channel apparatus 10 of the present invention with no container 11 or divider insert 13. The preferred embodiment of the vertical channel apparatus 10 would be one piece and consist of and features a fastener in the form of a clip/attachment mechanism 15, a backplate 14 and a vertical channel 16 for a divider/partition insert. The clip/attachment mechanism 15 will feature a low profile to more easily be used with file box/container lids.

Figure 9:
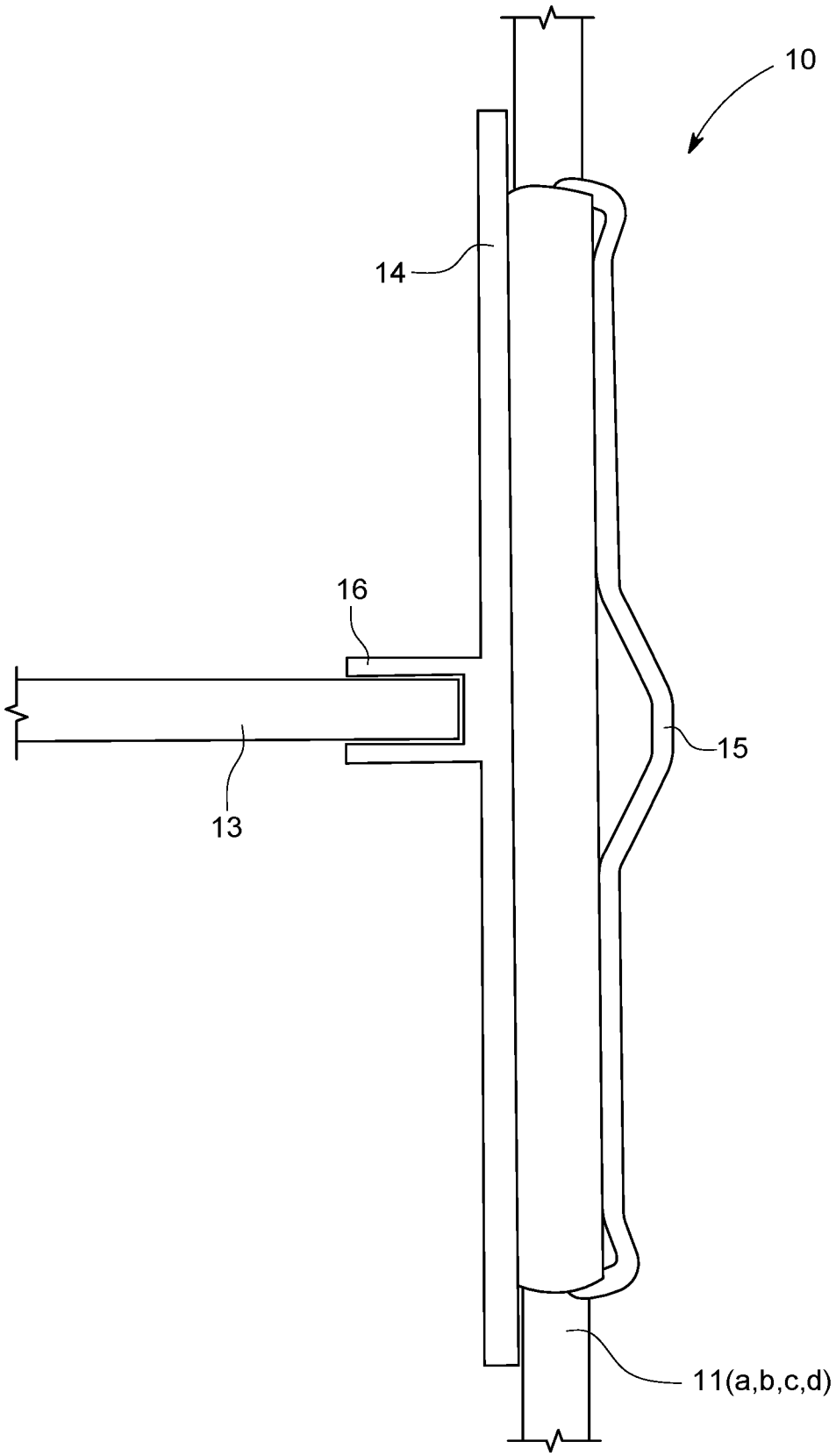
FIG. 9 is a top perspective view of the top of the vertical channel apparatus and top edge of the container wall depicting the spring clip embodiment of the attachment mechanism of the invention.

FIG. 9 shows a top view of the vertical channel apparatus 10 temporarily attached by spring clip mechanism 15 embodiment to a file box/container wall 11(*a,b,c,d*) with the divider inserted. The relatively low impact clip(s) 15 serve to prevent/minimize container wall damage 11(*a,b,c,d*) and to make placing, repositioning and removing the vertical channel apparatuses 10 quick and easy.

Figure 10:
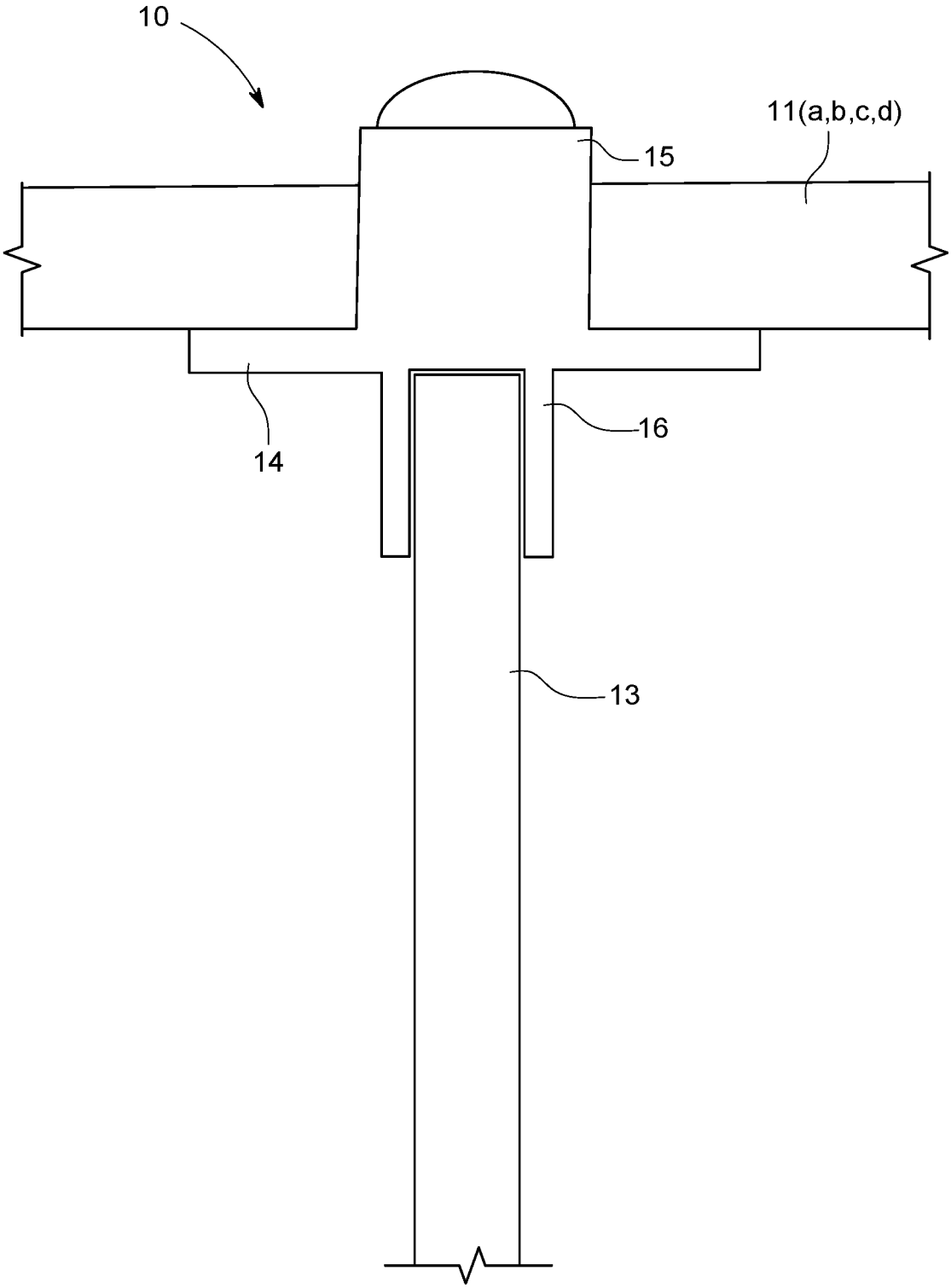
FIG. 10 is a top perspective view of the top of the vertical channel apparatus and top edge of the container wall depicting the tension clip embodiment of the attachment mechanism of the invention.

FIG. 10 shows a top view of the vertical channel apparatus 10 temporarily attached by tension clip mechanism 15 embodiment to a file box/container wall 11(*a,b,c,d*) with the divider inserted. The relatively low impact clip(s) 15 serve to prevent/minimize container wall damage 11(*a,b,c,d*) and to make placing, repositioning and removing the vertical channel apparatuses 10 quick and easy.

Figure 11:
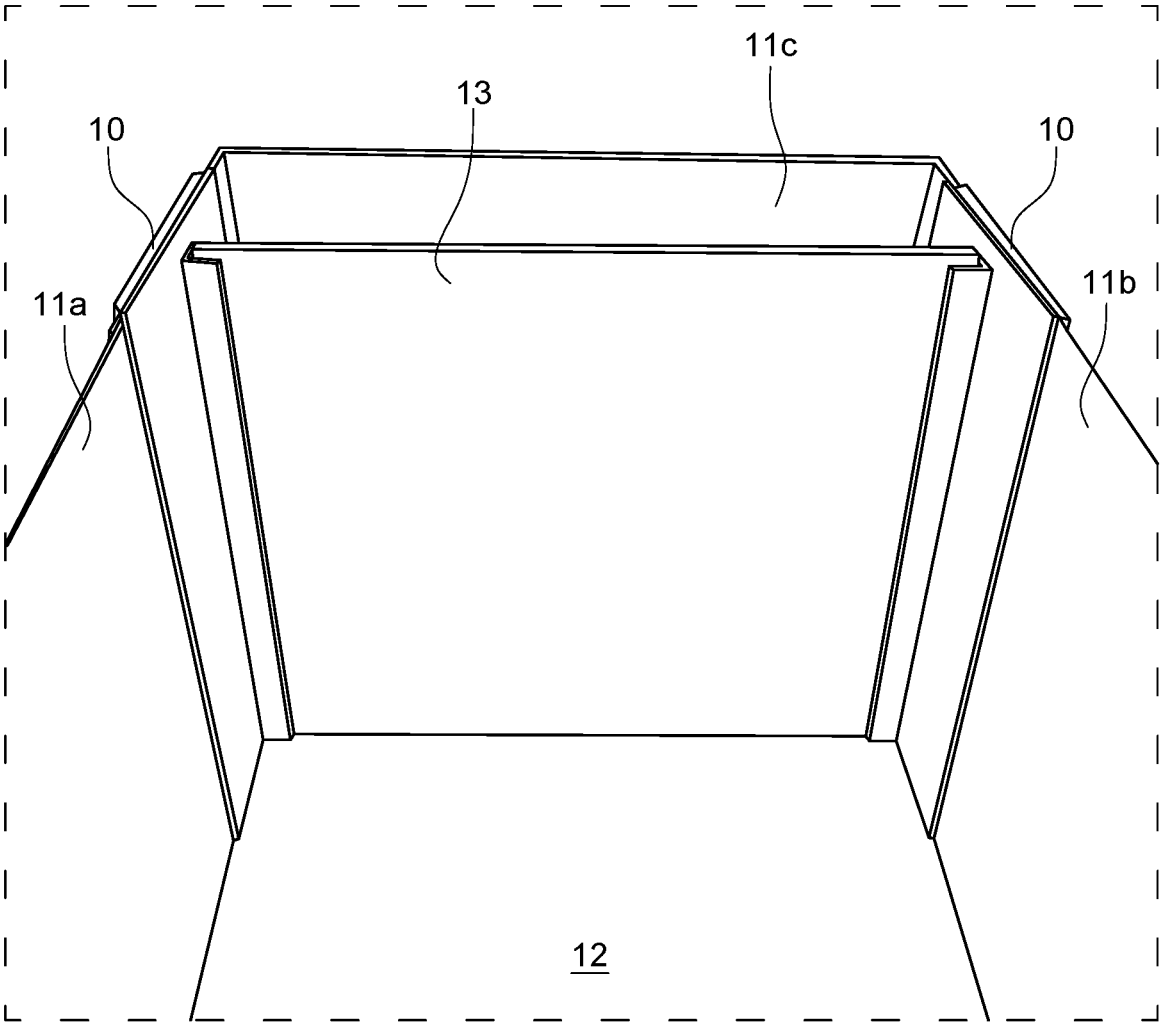
FIG. 11 is a front perspective cutaway view of a container with the repositionable vertical channel apparatuses impermanently attached and removable divider in place creating a separate compartment within the container.

FIG. 11 shows a cutaway front perspective view of the vertical channel apparatuses 10 within a file box/container 11 with the divider insert 13. Each vertical channel apparatus 10 is temporarily attached to opposite file box/container 11 walls 11*a*, 11*b* with the removable divider 13 inserted creating a partition and separate compartment within the file box/container 11.

Figure 12:
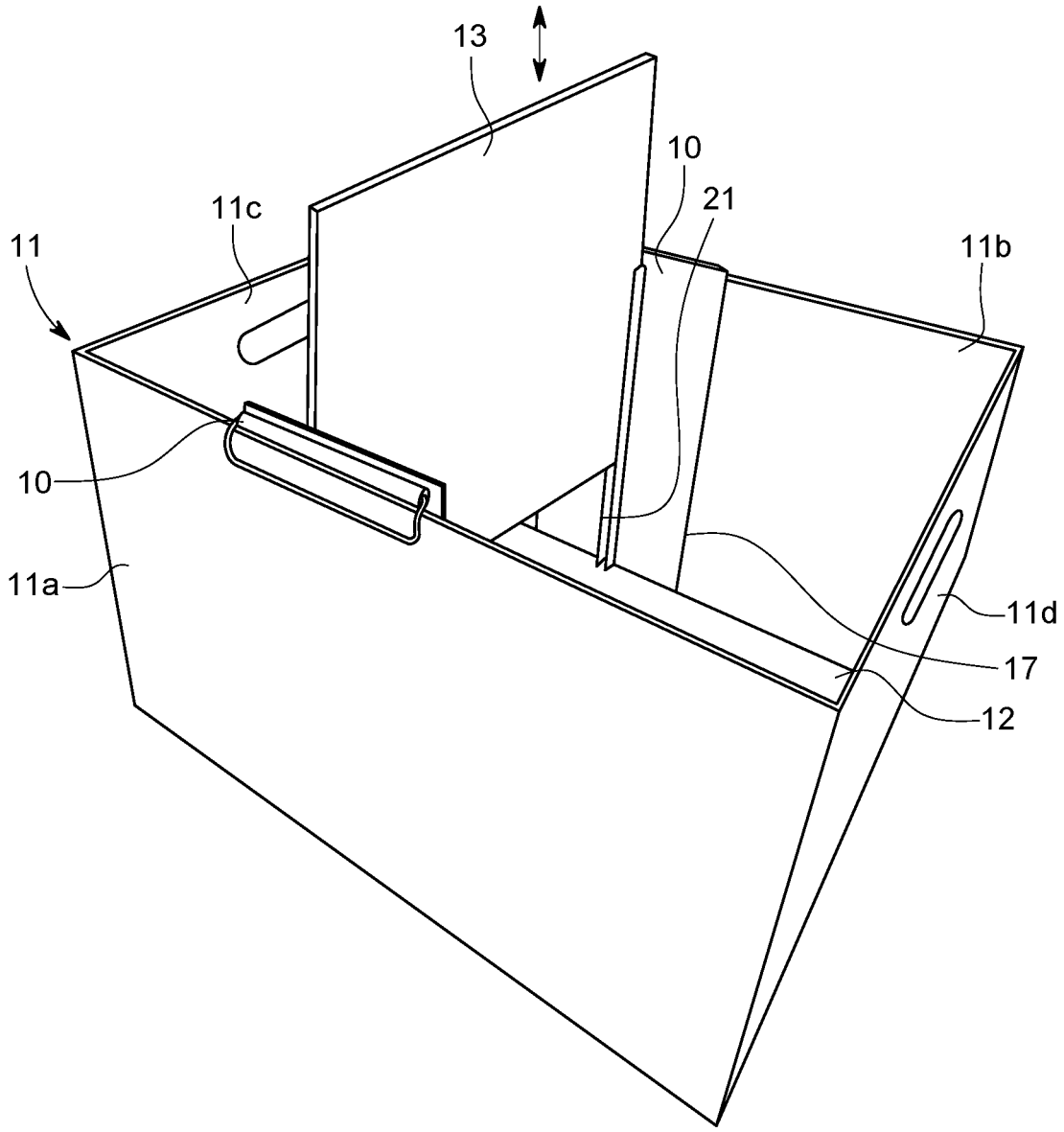
FIG. 12 is a perspective view of a container with the repositionable vertical channel apparatuses impermanently attached and removable divider process of insertion or removal.

FIG. 12 shows a perspective view of the repositionable vertical channel apparatuses 10 of the present invention with the divider partition 13 being removed from the file box/container 11.

Figure 13:
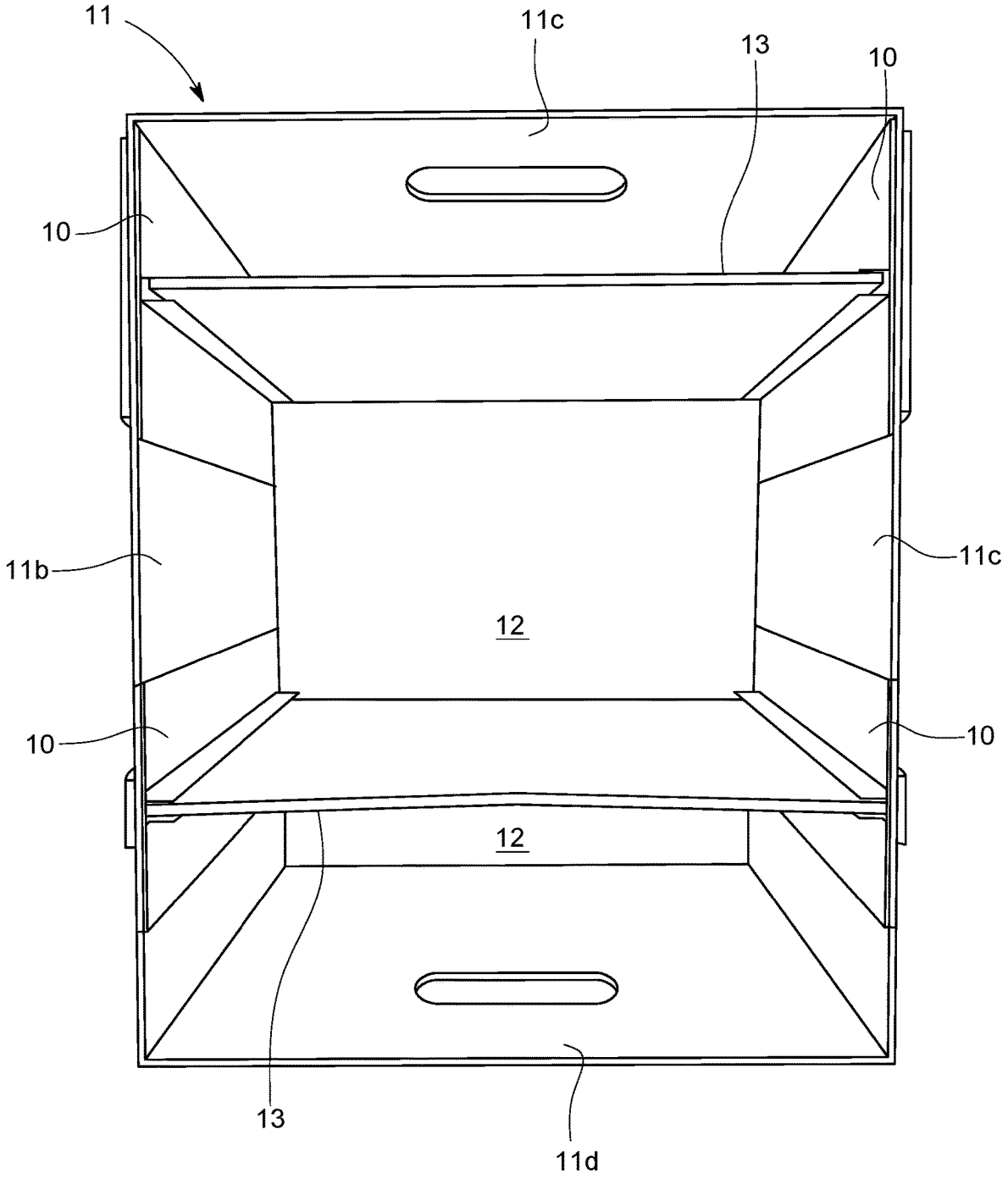
FIG. 13 is a top perspective view depicting two sets of the vertical channel apparatuses of the present invention impermanently attached to the container walls with dividers inserted partitioning the container.

FIG. 13 is a top perspective view depicting two sets of the vertical channel apparatuses 10 (with different backplates 14 and clip mechanisms 15) partitioning different sides of the file box/container 11.

Figure 14:
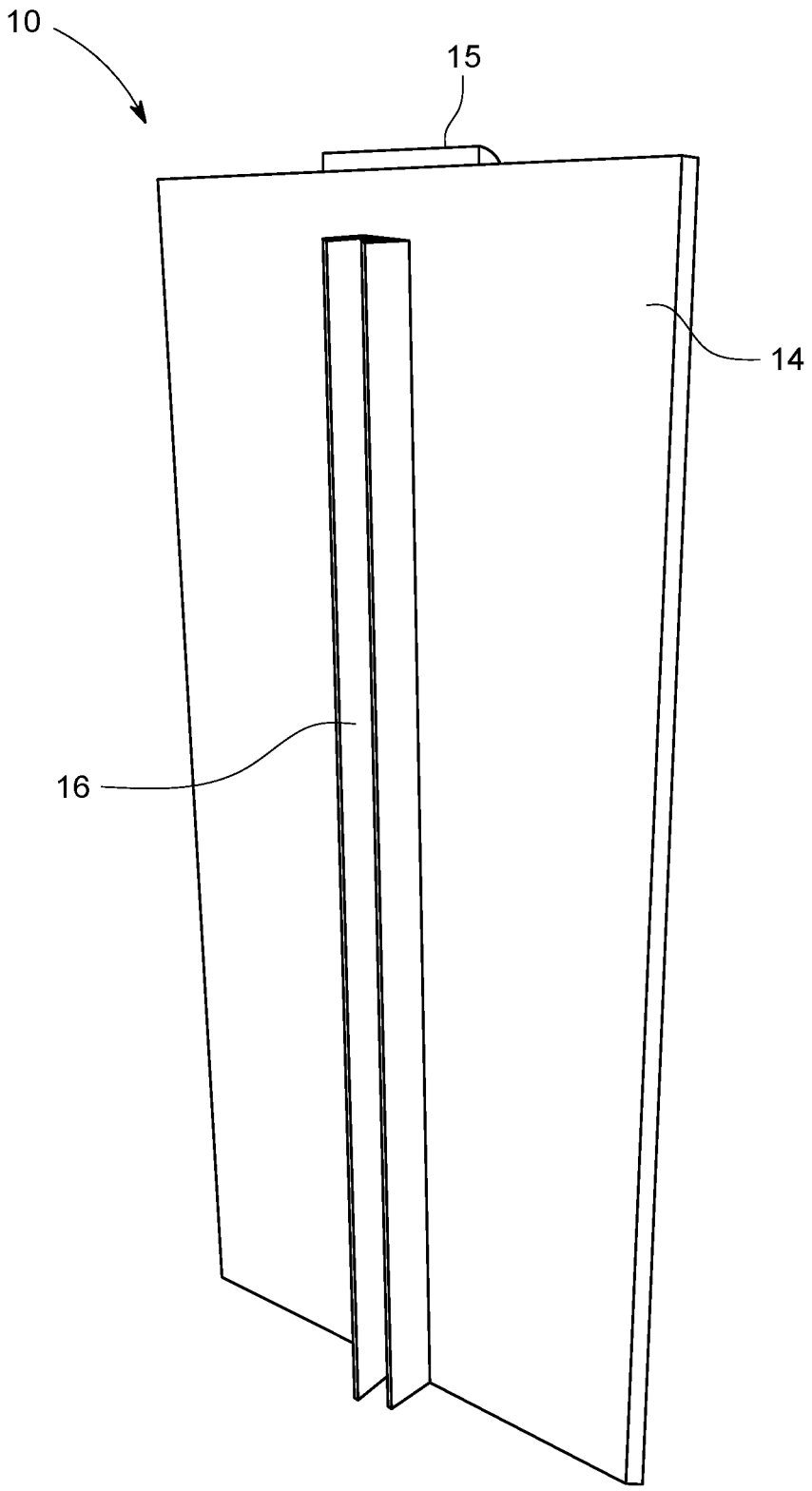
FIG. 14 is a perspective view of the vertical channel apparatuses of the present invention.

FIG. 14 is a front perspective view of a vertical channel apparatus 10 of the present invention without the matching opposite side vertical channel apparatus 10 comprising the pair and without a file box/container 11.

Figure 15A:
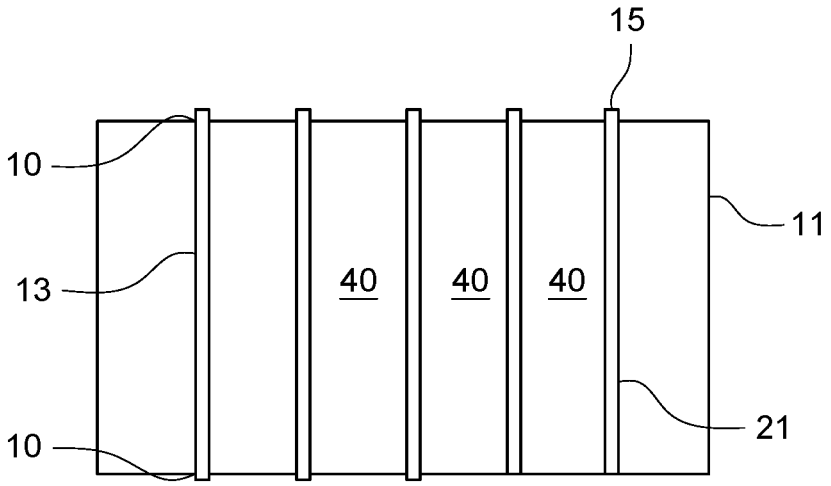
FIG. 15A is a diagrammatic illustration of a compartmented container in a first configuration.
Figure 15B:
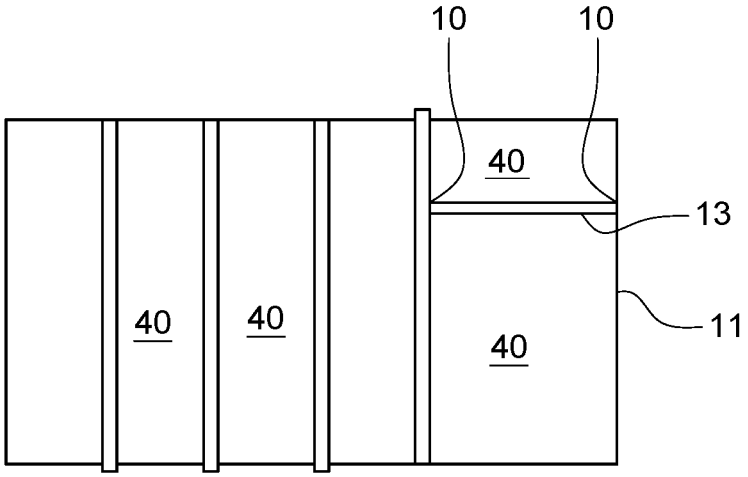
FIG. 15B is a diagrammatic illustration of a compartmented container in a second configuration.
Figure 15C:
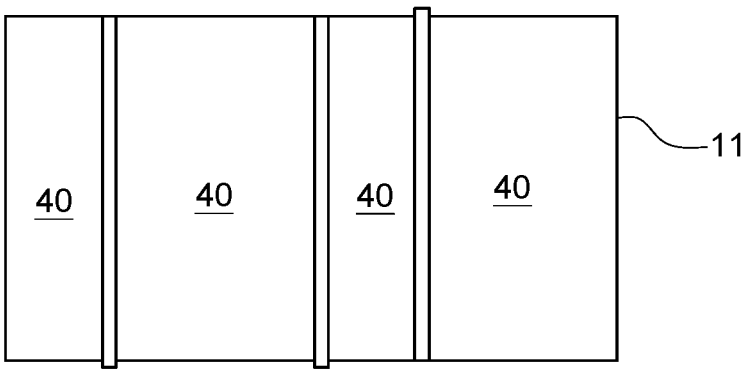
FIG. 15C is a diagrammatic illustration view of a compartmented container in a third configuration.

Referring now to FIGS. 15A-15C a plan view of 3 possible configurations is shown. 15A shows evenly spaced compartments 40 using apparatuses 10 to form insertion slots 21 for dividers 13. In this configuration, backplates 14 are essentially tiled so that compartments 40 formed will all be of even size assuming apparatuses 10 with the same width backplates 14 are used. This tiling helps prevent relative sliding of apparatuses 10 as the backplates 14 cannot be made to slide over each other or overlap. This arrangement has the added benefit of eliminating a single stress point (e.g., clip 15) for components forming the compartments 40, as they may be made of cardboard or other such material that can fatigue over time. Attachment clips 15 working in combination with the backplate 14 operate in tandem to prevent unintended movement of the apparatuses 10 resulting in (or from) the weight shifting of the container 11 contents in this configuration, as the abutment edges 17, 23 are positioned edge to edge. FIG. 15B shows a configuration with larger compartments 40, the larger compartment formed at the discretion of the user seeking to accommodate are relatively large file grouping. FIG. 15C shows a divider 13 used to form a small compartment 40 used to contain small or irregular objects that can accompany files or paperwork.

In use, a user simply positions at least two of the vertical channel apparatuses 10 on opposing sides (or a divider 13) of the container 11 in the manner discussed above to form an effective insertion slot 21, taking care to ensure that the channels 16 are aligned, so that a divider 13 positioned in the slot is at a substantially right angle (FIG. 12) to the opposing sides of the container 11 thereby forming a rectangular compartment 40 of a desired size and width. The width of the compartment 40 is chosen to be commensurate with the width of the items to be positioned therein, which allows the items to remain in an upright position which, in the case of paper files, allows for both easier insertion and removal as discussed above. The user may repeat the process to form as many compartments 40 as desired, limited only by the size of the container 11. The width of the backplate 14 dictates the minimum spacing between adjacent insertion slots 21, and in accordance with the inventive system, the user may use backplates 14 with different widths to form a series of compartments 40 having varying sizes. It should be noted also that the fastening clip 15 will secure the apparatus 10 in non-slidable relation to the container sidewalls 11*a-d*, the width of the compartments 40 can then be decided solely on the basis of the chosen position of opposing pairs of apparatuses 10, assuming backplates 14 of minimum widths are utilized. It can be appreciated that the fastening clip 15 working in combination with the width of the backplate 14 (when tiled edge 17 to edge 17 as discussed above) serves to maintain the size of the compartment even with heavy loads, as the backplates 14 and fastener 15 work in concert to prevent unintended repositioning of the dividers 13 due to excessive weight contained within a given compartment.

It is to be understood that the present invention is not limited to the sole embodiment described above, but encompasses any and all embodiments within the scope of the following claims:

The invention claimed is:

1. A container partitioning system for forming variably sized compartments within a container having sidewalls each with an upper rim and a bottom panel comprising:

at least a pair of vertical channel apparatuses each apparatus having a vertically disposed insertion slot, each of said apparatuses releasably attachable to a top edge of one of said sidewalls by a clip, the clip secured about said upper rim and having a backplate with a back side and a front side, said back side substantially flat and said front side having the vertically disposed insertion slot formed therein, said backplate having laterally opposed abutment edges extending from said top edge of one of said sidewalls to said bottom panel when said clip is secured to one of said sidewalls, and said vertical channel apparatuses extending from said bottom panel to a said top edge of said sidewalls when said apparatuses are fully inserted into said container;

at least one dividing panel having opposing edges dimensioned for slidable insertion into said slots;

whereby said vertical channel apparatuses are positioned as opposing pairs on opposing sidewalls of said container to provide opposing insertion slots so one of said dividing panels can be inserted therein to form a compartment, and said abutment edges maintain spacing between said vertical channel apparatuses.

2. The system of claim 1 wherein each of said backplates have a width defined by abutment edges on opposing sides.

3. The system of claim 2 wherein said backplates have a top end and a bottom end, said bottom end wider than said top end, and wherein said width is defined as spacing between opposing tips of said bottom end.

4. The system of claim 1 wherein said abutment edges serve to prevent movement of said apparatuses relative to said sidewalls.

5. The system of claim 1 wherein said abutment edges serve to prevent movement of said apparatuses relative to any adjacent apparatus.

6. The system of claim 1 wherein said apparatuses are positioned side by side to make two or more compartments of even size, said even size of said compartments maintained by the abutment edges of the backplates of said apparatuses.

7. The system of claim 1 wherein said clip is spring loaded.

* * * * *